US009604476B2

(12) United States Patent
Shimakawa

(10) Patent No.: US 9,604,476 B2
(45) Date of Patent: Mar. 28, 2017

(54) PAPER CUTTING APPARATUS AND PRINTING APPARATUS

(75) Inventor: Masaharu Shimakawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1201 days.

(21) Appl. No.: 13/366,457

(22) Filed: Feb. 6, 2012

(65) Prior Publication Data

US 2012/0204689 A1 Aug. 16, 2012

(30) Foreign Application Priority Data

Feb. 16, 2011 (JP) ..... 2011-031257

(51) Int. Cl.

| | |
|---|---|
| ***B41J 11/70*** | (2006.01) |
| ***B26D 5/40*** | (2006.01) |
| ***B41J 11/00*** | (2006.01) |

(52) U.S. Cl.

CPC ..... *B41J 11/706* (2013.01); *B26D 5/40* (2013.01); *B41J 11/003* (2013.01); *Y10T 83/088* (2015.04); *Y10T 83/141* (2015.04); *Y10T 83/8822* (2015.04)

(58) Field of Classification Search

CPC ..... B41J 11/706; B41J 11/003; B26D 1/185; B26D 7/015; B26D 5/40; Y10T 83/8822; Y10T 83/7763; Y10T 83/7507; Y10T 83/8769; Y10T 83/141; Y10T 83/536; Y10T 83/088

USPC ..... 83/614, 455, 485; 400/621

See application file for complete search history.

(56) References Cited

U.S. PATENT DOCUMENTS

| | | | | |
|---|---|---|---|---|
| 6,408,750 | B1 * | 6/2002 | Goto et al. | 101/226 |
| 6,520,701 | B2 * | 2/2003 | Kaya | 400/621 |
| 6,648,532 | B2 | 11/2003 | Furuya et al. | |
| 7,124,670 | B2 | 10/2006 | Tanaka et al. | |
| 8,911,167 | B2 * | 12/2014 | Kanazawa et al. | 400/621 |
| 2005/0229756 | A1 | 10/2005 | Tanaka et al. | |
| 2012/0024121 | A1 * | 2/2012 | Balahan et al. | 83/13 |

FOREIGN PATENT DOCUMENTS

| | | |
|---|---|---|
| JP | 01-127297 A | 5/1989 |
| JP | 05-104495 A | 4/1993 |
| JP | 05-104496 A | 4/1993 |
| JP | 05-337876 | 12/1993 |

(Continued)

OTHER PUBLICATIONS

JP05-104496 translation; Nakazawa, Noriaki , Apr. 27, 1993, B26D007/22.*

*Primary Examiner* — Laura M Lee

(74) *Attorney, Agent, or Firm* — Fitzpatrick, Cella, Harper & Scinto

(57) ABSTRACT

A paper cutting apparatus comprises a cutting unit to cut paper, a moving unit to move the cutting unit in a direction intersecting the conveyance direction of the paper, and a motor to drive the moving unit. The paper cutting apparatus also includes a detection unit to detect the current value of the motor and a determination unit to determine the state of the current value while the cutting unit that has begun moving from a specific position toward a target stop position is moving from a downstream end of the paper to a predetermined target stop position in the movement direction of the cutting unit. A control unit is configured to stop the drive of the motor on the basis of the determination result of the determination unit.

9 Claims, 6 Drawing Sheets

(56) References Cited

FOREIGN PATENT DOCUMENTS

| | | | |
|---|---|---|---|
| JP | 06-105065 | A | 4/1994 |
| JP | 07-067385 | A | 3/1995 |
| JP | 10-315198 | A | 12/1998 |
| JP | 2000-218505 | A | 8/2000 |
| JP | 2000-263491 | A | 9/2000 |
| JP | 2002-036178 | A | 2/2002 |
| JP | 2002-104717 | A | 4/2002 |
| JP | 2002-239975 | A | 8/2002 |
| JP | 2004-009155 | A | 1/2004 |
| JP | 2005-271112 | A | 10/2005 |
| JP | 2006-224221 | A | 8/2006 |
| JP | 2007-061985 | A | 3/2007 |

* cited by examiner

PAPER CUTTING APPARATUS AND PRINTING APPARATUS

BACKGROUND OF THE INVENTION

Field of the Invention

The present invention relates to a paper cutting apparatus and a printing apparatus.

Description of the Related Art

A printing apparatus (such as a printer) for printing images on rolled paper, for example, has been known in the past. With a printing apparatus that prints on rolled paper, a cutter mechanism is generally provided that automatically cuts the rolled paper every time the printing of an image is finished. There are many different types of cutter mechanism, depending on how it is configured, such as a guillotine type that thrusts a blade into a gap, or a scissors type that crosses two blades and cuts from the end of the paper. Regardless of the type, the cutting of the paper is carried out by moving one or more blades.

Even though a cutter mechanism may operate without a problem during normal operation, if the paper should jam, or if a foreign substance should become lodged in the cutter mechanism, the blade or blades may not be able to work properly, resulting in a locked state. To deal with this, a technique has been disclosed in Japanese Patent Laid-Open No. 05-337876 in which the motor is reversed and the blade pulled back in the event of a locked state.

In general, the above-mentioned locked state occurs most often when a foreign substance becomes lodged between the cutter mechanism and the end of the paper opening of the apparatus main body. If a foreign substance becomes lodged during the cutting of paper, however, a state in which the load gradually builds up will usually continue for a time, with lock-up not occurring right away.

If current is used to detect lock-up, since the load varies with the type of paper, there will be a large change in the current during paper cutting. Accordingly, there is the possibility that mis-detection will occur.

If, for example, lock-up is detected during paper cutting, the printing apparatus reverses the motor and moves the cutter mechanism to its home position, etc. In this case, the paper ends up being cut only part of the way. This partially cut paper will tear at the partial cut line under the weight of the paper, so in a worst case scenario, the printed image portion ends up being ripped.

SUMMARY OF THE INVENTION

The present invention provides a technique with which there is less mis-detection during the detection of whether or not a foreign substance has become lodged in the cutter mechanism, and the paper cutting processing can be carried out properly.

According to a first aspect of the present invention, there is provided a paper cutting apparatus, comprising: a cutting unit configured to cut paper; a moving unit configured to move the cutting unit in a direction intersecting the conveyance direction of the paper; a motor configured to drive the moving unit; a detection unit configured to detect the current value of the motor; a determination unit configured to determine the state of the current value while the cutting unit that has begun moving from a specific position toward a target stop position is moving from a downstream end of the paper to a predetermined target stop position in the movement direction of the cutting unit; and a control unit configured to stop the drive of the motor on the basis of the determination result of the determination unit.

According to a second aspect of the present invention, there is provided a printing apparatus, comprising the above described paper cutting apparatus, and a printhead.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Embodiment 1

Figure 1:
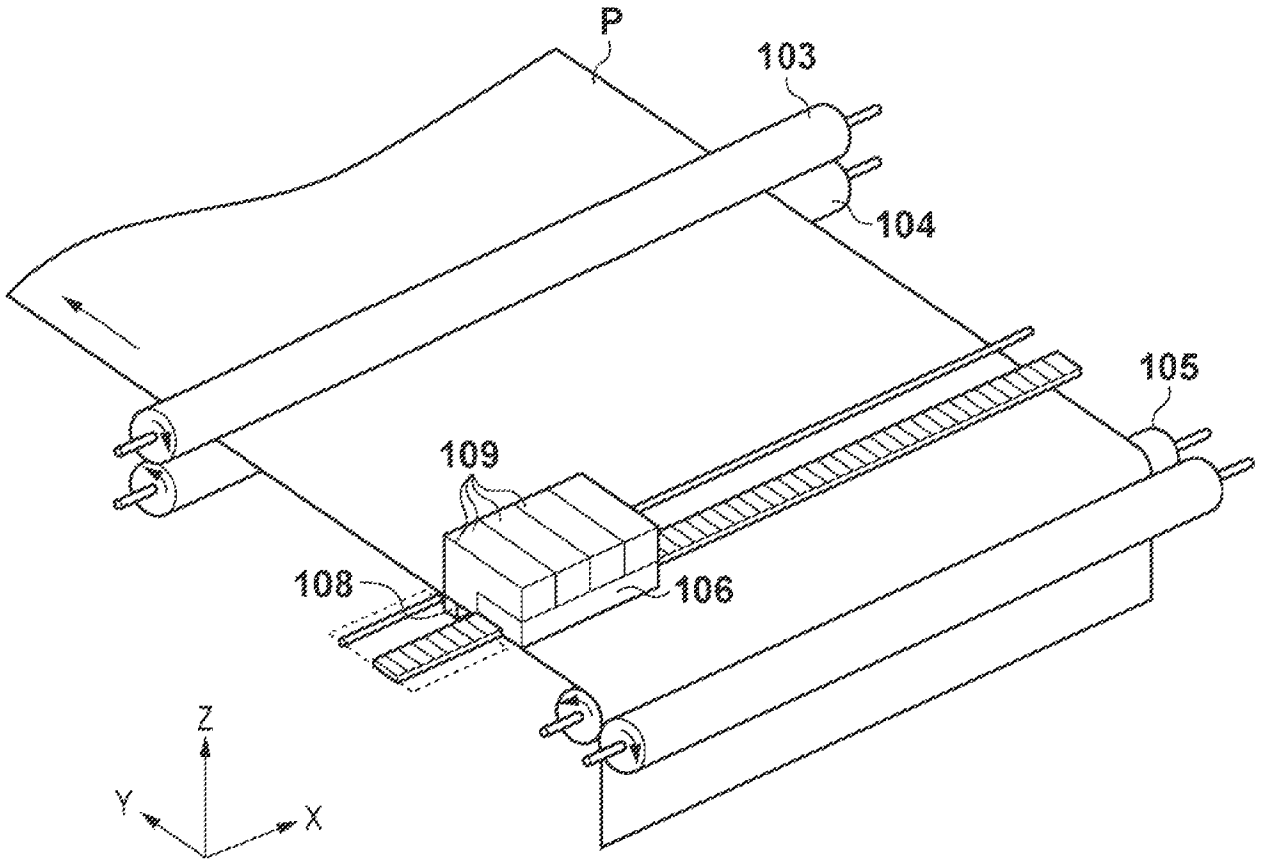
FIG. 1 is a diagram of an example of the external configuration of a printing apparatus 10 according to an embodiment of the present invention.

FIG. 1 is a diagram of an example of the external configuration of a printing apparatus 10 according to an embodiment of the present invention. In this embodiment, a printing apparatus that employs an inkjet system as its printing method will be described as an example, but inkjet is not the only option. For instance, a printing apparatus that employs an electrophotographic method or some other such method may be used.

The printing apparatus 10 has inkjet printheads (hereinafter referred to as printheads) 109, for printing by discharging ink by inkjet method, mounted on a carriage 106. Printing is performed by moving the carriage 106 back and forth in the main scanning direction (X direction). If the printing apparatus 10 is not performing a print operation, or if a restoration operation is being performed on the printheads 109, the carriage 106 is controlled so as to stand by at its home position, indicated by the dotted line in the drawing.

The printing apparatus 10 uses a paper roller 105 to feed a printing medium (in this embodiment, this is rolled paper, which will hereinafter be referred to merely as paper) and convey it to the printing position. Printing is then performed by discharging ink from each printhead 109 onto the paper P at this printing position. Once the print scanning of the printheads 109 is finished, a conveyance roller 103 and an auxiliary roller 104 rotate and convey the paper P in the sub-scanning direction (Y direction) by an amount corresponding to the printing width of the printheads 109. This print scanning and conveyance operation are repeated until an image is printed on the paper P.

An electrothermal transducer is provided, for example, as a printing element to each of the printheads 109. Specifically, the printheads 109 use thermal energy to discharge ink. The electrothermal transducers are provided corresponding to the orifices, and pulse voltage is applied to the electrothermal transducers corresponding to image data. Consequently, ink is discharged from the corresponding orifices. In this embodiment, a case in which a heater is used to discharge the ink is described as the ink discharge method, but this is not the only option. For example, a method involving the use of a piezoelectric element, a method involving the use of an electrostatic element, a method involving the use of an MEMS element, or any of various other inkjet methods may be employed.

Four ink cartridges that hold yellow (Y), magenta (M), cyan (C), and black (Bk) ink are installed in addition to the printheads 109 on the carriage 106 of the printing apparatus 10. These ink cartridges hold the ink supplied to the various printheads 109. These four ink cartridges can each be independently removed and installed.

Figure 2:
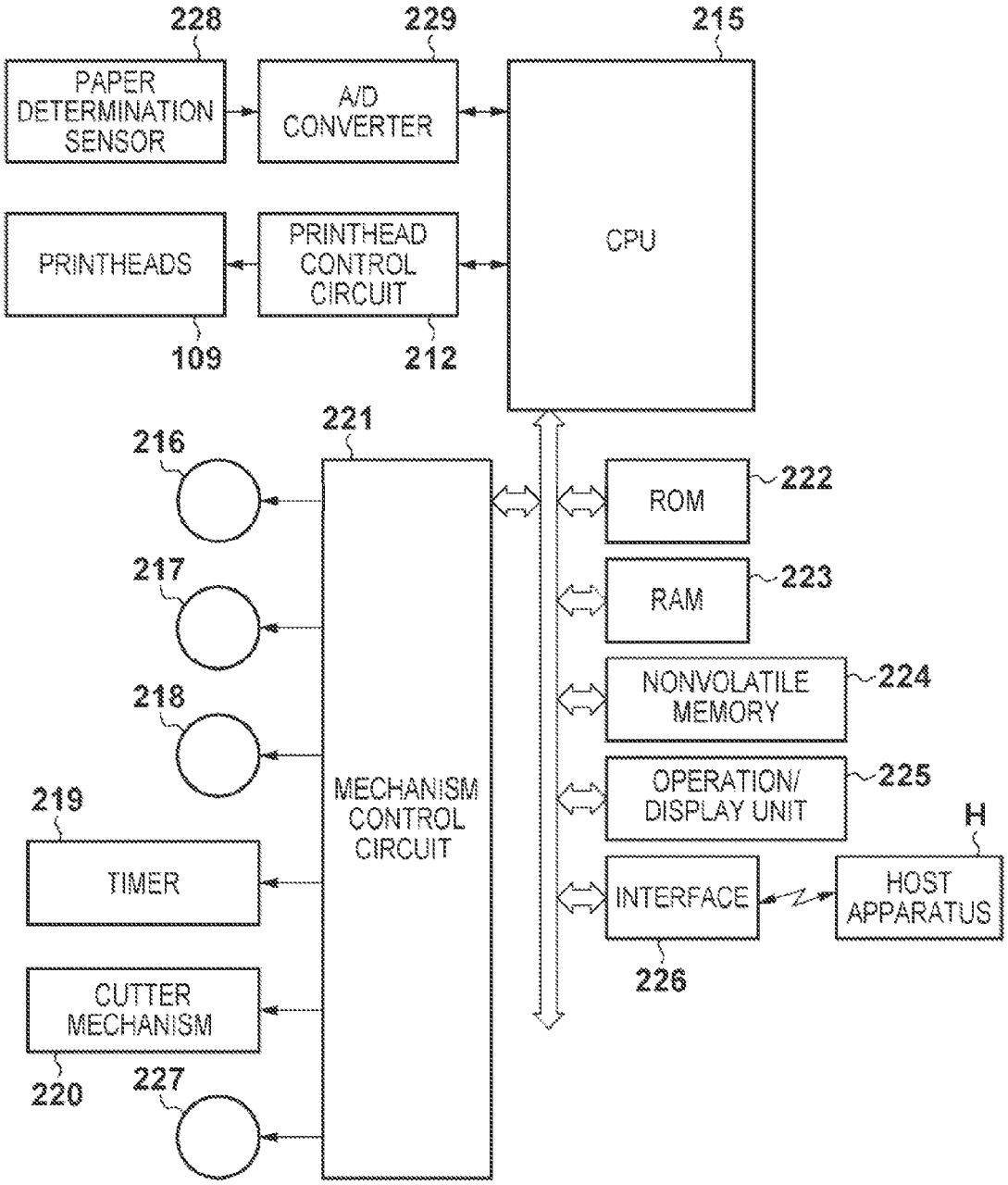
FIG. 2 is a diagram of an example of the configuration of the control system of the printing apparatus 10 shown in FIG. 1.

FIG. 2 is a diagram of an example of the configuration of the control system of the printing apparatus 10 shown in FIG. 1.

The CPU (central processing unit) 215 provides overall control of the various units in the printing apparatus 10. A ROM (read only memory) 222 stores programs executed by the CPU 215. The ROM 222 may also be configured to allow writing.

A RAM (random access memory) 223 temporarily stores various types of data. For example, when various processing is performed by the CPU 215, it is utilized as a working area. A nonvolatile memory 224 is an EEPROM, for example, and holds its stored content even when the power is off. The moving speed of the cutter mechanism 220 and the like are stored in the nonvolatile memory 224.

An operation/display unit 225 functions as a user interface, and includes, for example, switches that the user manipulates to turn on the power, go online or offline with a host apparatus H, and so forth, and a display device for notifying the user of the apparatus status.

The host apparatus H functions as a supply source to supply image data to the printing apparatus 10, and consists of a computer that performs image and other data production and processing according to print processing. The host apparatus H may be a reader for reading images, a digital camera, or the like.

An interface 226 functions as a communications interface that communicates with the host apparatus H and so forth. For instance, image data, various commands, status signals, and the like are sent back and forth via this interface 226.

A printhead control circuit 212 provides overall control of the printheads 109. More specifically, it electrically controls the printheads 109 to cause them to discharge ink according to the image data.

A paper determination sensor 228 has the function of determining the paper, and is installed on the carriage 106, for example, and detects the type of paper P and the paper width as analog values. These detected analog values are converted into digital values by an A/D converter 229, after which they are inputted to the CPU 215. Specifically, the CPU 215 performs determination of the paper type and width on the basis of digital values received via the A/D converter 229. The term "paper width" here indicates the width of the paper in relation to a direction perpendicular to the conveyance direction of the paper (perpendicular direction).

A plurality of motors 216 to 218 and 227 are provided to the printing apparatus 10. A main scanning motor 216 supplies drive for scanning the printheads 109 in the X direction shown in FIG. 1 (the main scanning direction). A sub-scanning motor 217 supplies drive for conveying the paper P in the Y direction shown in FIG. 1 (the sub-scanning direction). A restoration operation motor 218 supplies drive for operating a restoration processing unit. A cutter motor 227 supplies drive for operating the cutter mechanism 220 in order to cut the paper P.

The mechanism control circuit 221 provides overall control over the various motors and actuators, the various sensors, and so forth. The cutter mechanism 220 has the function of a paper cutting mechanism, and cuts paper. A timer 219 times the various operations. The above is a description of an example of the configuration of the control system in the printing apparatus 10.

Figure 3:
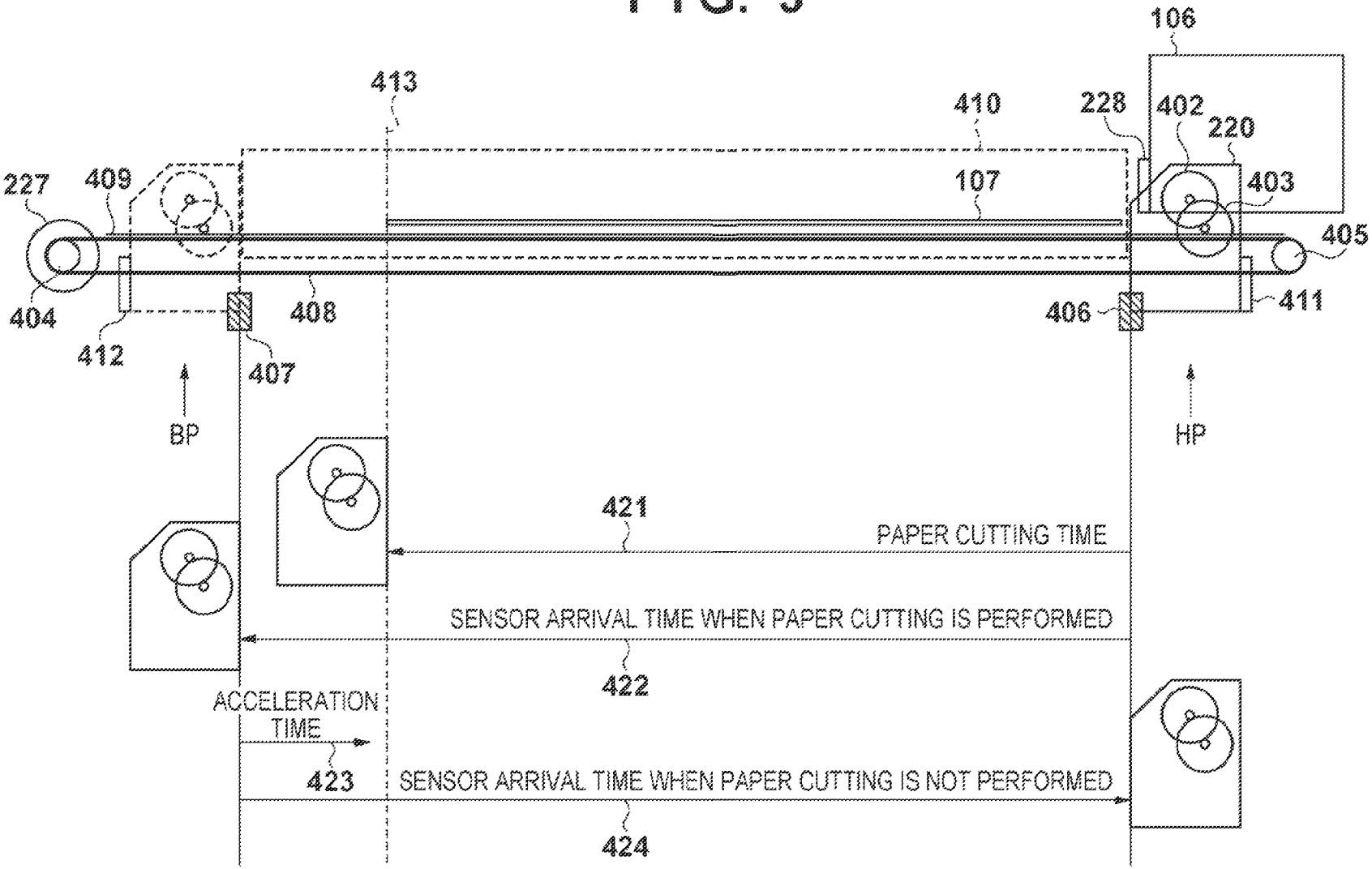
FIG. 3 is a diagram of an example of the simplified configuration of a cutter mechanism 220 shown in FIG. 2.

Next, an example of the simplified configuration of the cutter mechanism 220 shown in FIG. 2 will be described through reference to FIG. 3. As shown in FIG. 3, the cutter mechanism 220 moves in a direction intersecting the conveyance direction of paper 107.

An upper blade 402 and a lower blade 403 are provided to the cutter mechanism 220. The upper blade 402 and the lower blade 403 are disposed on the reference side of the paper 107 (corresponds to the paper P shown in FIG. 1), and fixed to a loop-shaped wire 408. The wire 408 is movably supported by a drive pulley 404 provided to the cutter motor 227, and a driven pulley 405 on the home position (HP) side. Here, one end along the direction perpendicular to the conveyance direction of the paper 107 (the stop position side of the cutter mechanism 220 at the start of paper cutting) shall be termed the HP, and the other end the BP.

When the drive pulley 404 is rotationally driven, the wire 408 moves. This movement of the wire 408 moves the cutter mechanism 220 to the left and right along a rail 409. This movement of the cutter mechanism 220 also causes the paper 107 to be cut in a specific length. After the paper 107 has been cut, the cutter mechanism 220 moves farther and reaches the back position (BP) side.

When the cutter mechanism 220 reaches the BP side, a stop position detecting sensor 407 on the BP side (that is, a stop position detecting sensor on the back position side) is switched on. The CPU 215 then receives this detection signal, momentarily reverses the rotation of the cutter motor 227, and brakes the cutter mechanism 220 to a stop. The cutter mechanism 220 at this point keeps moving momentarily due to its momentum, but comes into contact with a BP stopper 412 on the BP side and stops. The cut paper is conveyed by a conveyance roller (not shown) in a specific direction, and is discharged from an opening 410.

The distal end of the cut paper is pulled back by the conveyance roller. The cutter motor 227 reverses its rotation and moves the cutter mechanism 220 to the HP side. Once the cutter mechanism 220 reaches the HP side, an HP-side stop position detecting sensor 406 (a stop position detecting sensor on the home position side) is switched on. When this happens, the CPU 215 that has received this detection signal momentarily reverses the rotation of the cutter motor 227, and brakes the cutter mechanism 220 to a stop. The cutter mechanism 220 stops in contact with an HP stopper 411 on the HP side. Also, the paper determination sensor 228 provided to the carriage 106 determines the type and width of the paper 107.

Figure 4:
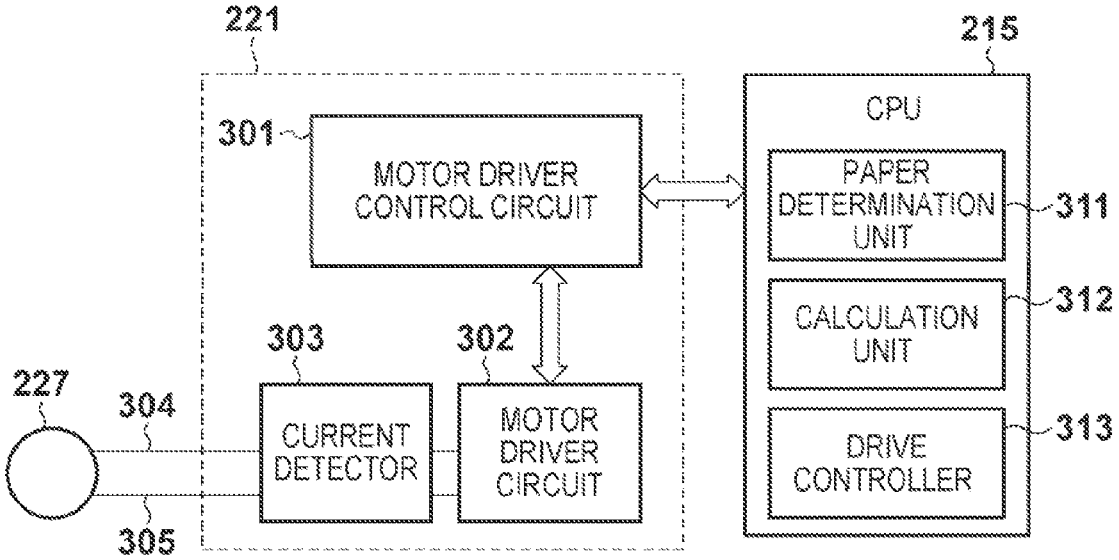
FIG. 4 is a diagram of an example of the configuration of the control system of a mechanism control circuit 221 shown in FIG. 2 and the functional configuration realized with a CPU 215.

Next, an example of the configuration of the control system of the mechanism control circuit 221 shown in FIG. 2, and the functional configuration realized in the CPU 215 will be described through reference to FIG. 4. Here, the configuration of the mechanism that detects the drive current value of the cutter motor 227 will be described in particular.

The mechanism control circuit 221 is connected to the CPU 215. Therefore, the CPU 215 performs its control of the cutter motor 227 via the mechanism control circuit 221. The cutter motor 227 is connected to a cutter motor positive phase 304 and a cutter motor negative phase 305.

The mechanism control circuit 221 controls the drive of the cutter motor 227 on the basis of commands from the CPU 215. Here, a motor driver control circuit 301, a motor driver circuit 302, and a current detector 303 are provided inside the mechanism control circuit 221. The motor driver circuit 302 drives the cutter motor 227, and the motor driver control circuit 301 controls the motor driver circuit 302. The current detector 303 detects the current generated during drive of the cutter motor 227. This allows the current detector 303 to detect the drive current value at the cutter motor 227.

An example of the functional configuration realized in the CPU 215 will now be described. The functional configuration in the CPU 215 is realized by a paper determination unit 311, a calculation unit 312, and a drive controller 313. The functional configuration realized in the CPU 215 is realized, for example, by executing various control programs stored in the ROM 222, etc.

The paper determination unit 311 determines the type and width of the paper on the basis of the output value from the paper determination sensor 228.

The calculation unit 312 calculates various information according to the cutting of the paper, on the basis of the paper type and width values determined by the paper determination unit 311 and the moving speed of the cutter mechanism 220 (stored ahead of time). More specifically, the paper cutting time, the sensor arrival time when paper cutting is performed, the sensor arrival time when paper cutting is not performed, and the acceleration time are calculated.

This information according to the cutting of paper will now be described through reference to FIG. 3.

The paper cutting time 421 is the time it takes for the cutter mechanism 220 to travel from the HP across the width of the paper (this indicates the length of the paper in the main scanning direction), and indicates the time it takes for the cutter mechanism 220 to cut the paper conveyed over the conveyance path from the point when it begins to move from the HP.

The sensor arrival time when paper cutting is performed 422 (back position arrival time) indicates the time it takes for the cutter mechanism 220 to reach the stop position detecting sensor 407 on the BP side from the point when it begins to move away from the HP. Specifically, the sensor arrival time when paper cutting is performed 422 indicates how long it takes for the cutter mechanism 220 to move between the HP and the BP during the cutting of paper.

The sensor arrival time when paper cutting is not performed 424 (home position arrival time) indicates the time it takes for the cutter mechanism 220 to reach the stop position detecting sensor 406 on the HP side from the point when it begins to move away from the BP. Specifically, the sensor arrival time when paper cutting is not performed 424 indicates how long it takes the cutter mechanism 220 to move between the HP and the BP without performing paper cutting.

The acceleration time (acceleration control period) 423 is the time (period) during which the cutter mechanism 220 accelerates from the BP side to the HP side. The acceleration time 423 is the period during which the drive current sent to the cutter motor 227 increases. After this acceleration time 423, the cutter mechanism 220 moves to the HP side according to the drive force imparted by the cutter motor 227 during the acceleration time 423. In FIG. 3, the acceleration time 423 ends before the arrival at a paper end 413 on the BP side, but this is not the only option, and the acceleration time 423 may be decided on according to the scanning range of the cutter mechanism 220 and so forth.

The drive controller 313 controls the flow of drive current to the cutter motor 227, and thereby controls movement between the HP and the BP by the cutter mechanism 220. The drive controller 313 also controls stoppage of the movement (drive) of the cutter mechanism 220 on the basis of changes in the drive current value detected by the current detector 303 and the output values of the HP-side and BP-side stop position detecting sensors 406 and 407.

Figure 5:
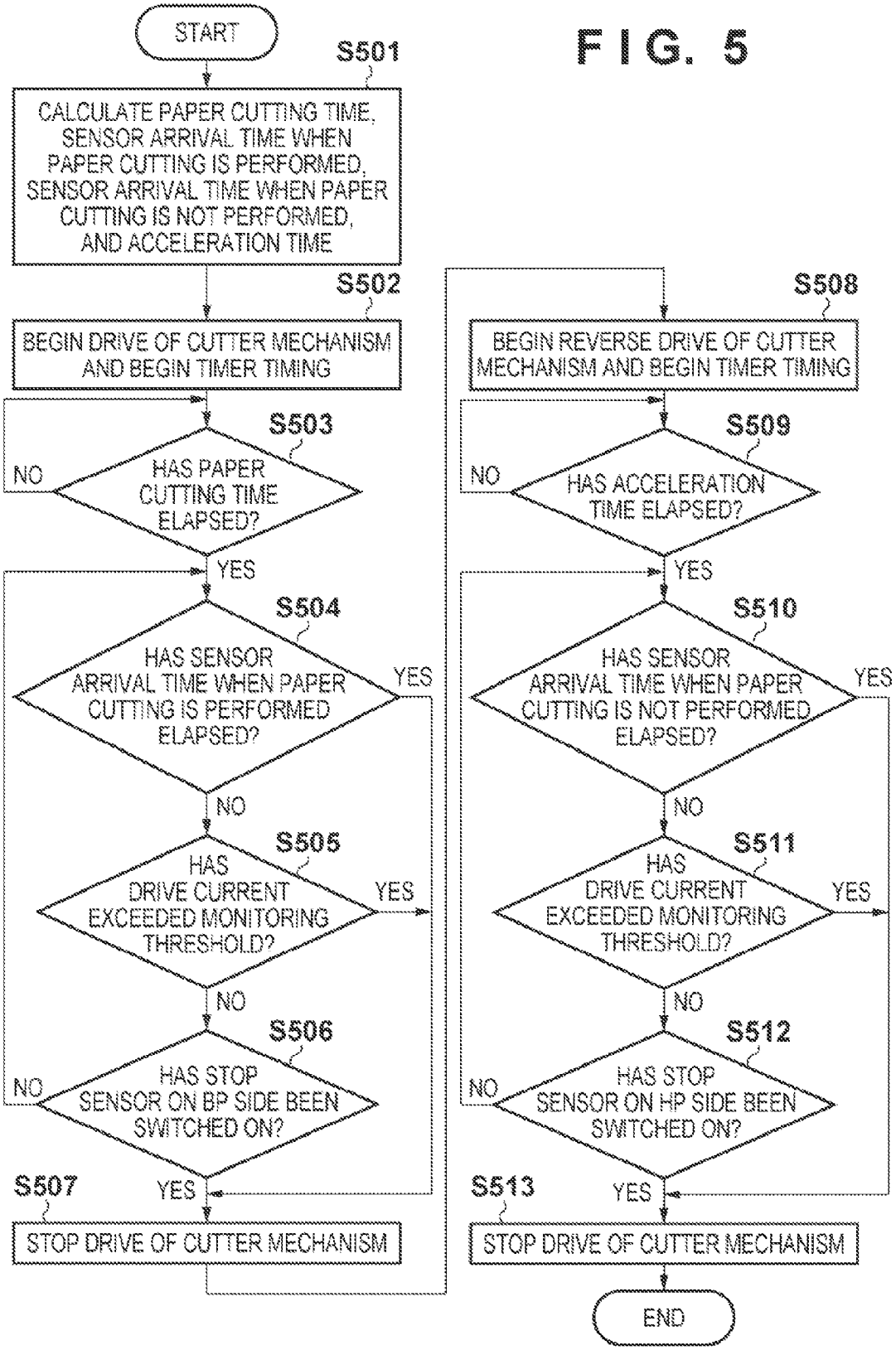
FIG. 5 is a flowchart of an example of the flow of paper cutting processing according to Embodiment 1.

Next, an example of the flow in paper cutting processing by the printing apparatus 10 shown in FIG. 1 will be described through reference to FIG. 5.

This processing begins when the printing of an image on the paper is completed by the printing apparatus 10. When this processing begins, the printing apparatus 10 first uses the calculation unit 312 to obtain values for the paper type and width determined by the paper determination unit 311, and various information according to the cutting of paper on the basis of the moving speed of the cutter mechanism 220 (S501). More specifically, the paper cutting time, the sensor arrival time when paper cutting is performed, the sensor arrival time when paper cutting is not performed, and the acceleration time are calculated.

Next, the printing apparatus 10 uses the drive controller 313 to begin the drive of the cutter motor 227, and to move the cutter mechanism 220 toward the BP side. Specifically, the paper cutting operation by the cutter mechanism 220 is commenced. The timing of the timer 219 is also commenced (S502).

The printing apparatus 10 at this point waits for the paper cutting time to elapse (No in S503). Once this time has elapsed (Yes in S503), the printing apparatus 10 uses the drive controller 313 to control the stoppage of the movement (drive) of the cutter mechanism 220 on the basis of various information. More specifically, drive of the cutter mechanism 220 is controlled on the basis of whether or not the sensor arrival time when paper cutting is performed has elapsed, whether or not the current value for the drive current has exceeded a monitoring threshold, and whether or not the stop position detecting sensor 407 on the BP side has been switched on. In this embodiment, monitoring of the drive current value is carried out from the point when the paper cutting time has elapsed until the sensor arrival time when paper cutting is performed has elapsed.

If the sensor arrival time when paper cutting is performed has elapsed (Yes in S504), the printing apparatus 10 uses the drive controller 313 to stop the movement of the cutter mechanism 220 (S507). On the other hand, if the drive current value has exceeded the monitoring threshold before the sensor arrival time when paper cutting is performed has elapsed (Yes in S505), then the printing apparatus 10 uses the drive controller 313 to stop the movement of the cutter mechanism 220 (S507). Here, it is determined whether or not the drive current value has exceeded the monitoring threshold (first threshold), but it may instead be determined whether or not the increase in the drive current value over a specific length of time has exceeded a specific threshold (second threshold).

Also, if the stop position detecting sensor 407 on the BP side has been switched on before the sensor arrival time when paper cutting is performed has elapsed (Yes in S506), then the printing apparatus 10 uses the drive controller 313 to stop the movement of the cutter mechanism 220 (S507).

After cutting the paper in the above steps S501 to S507, the cutter mechanism 220 is stopped at the BP. The printing apparatus 10 then uses the drive controller 313 to return the cutter mechanism 220 to its original position (move it to the HP side), so the cutter motor 227 reverses its rotation and moves the cutter mechanism 220 toward the HP side. After the timer 219 has been reset, the timing of the timer 219 is started over (S508).

The printing apparatus 10 then waits until the acceleration time (acceleration control period) has elapsed (No in S509). Specifically, during the acceleration time (acceleration control period), there is a sharp increase in the drive current sent to the cutter motor 227, so during this period there is no monitoring of the drive current. Consequently, in this embodiment there is less mis-detection caused by a foreign substance becoming lodged as the drive current increases during the acceleration time.

Once the acceleration time has elapsed (once the acceleration control period has ended) (Yes in S509), the printing apparatus 10 uses the drive controller 313 to control the stoppage of the movement (drive) of the cutter mechanism 220 on the basis of various information. More specifically, drive of the cutter mechanism 220 is controlled on the basis of whether or not the sensor arrival time when paper cutting is not performed has elapsed, whether or not the drive current value has exceeded a monitoring threshold, and whether or not the stop position detecting sensor 406 on the HP side has been switched on. In this embodiment, monitoring of the drive current value is carried out from the point when the acceleration time has elapsed until the sensor arrival time when paper cutting is not performed has elapsed.

If the sensor arrival time when paper cutting is not performed has elapsed (Yes in S510), the printing apparatus 10 uses the drive controller 313 to stop the movement of the cutter mechanism 220 (S513). On the other hand, if the drive current value has exceeded the monitoring threshold before the sensor arrival time when paper cutting is not performed has elapsed (Yes in S511), then the printing apparatus 10 uses the drive controller 313 to stop the movement of the cutter mechanism 220 (S513). Here, it is determined whether or not the drive current value has exceeded the monitoring threshold (first threshold), but it may instead be determined whether or not the increase in the drive current value over a specific length of time has exceeded a specific threshold (second threshold).

Also, if the stop position detecting sensor 406 on the HP side has been switched on before the sensor arrival time when paper cutting is not performed has elapsed (Yes in S512), then the printing apparatus 10 uses the drive controller 313 to stop the movement of the cutter mechanism 220 (S513). As a result of the processing in these steps S508 to S513, the cutter mechanism 220 is stopped at the HP, and returns to its original position.

As described above, with Embodiment 1, in the cutting of paper, the drive current value of the cutter motor 227 is monitored from the point when the cutting of the paper by the cutter mechanism 220 is completed until the BP is attained.

Also, in returning the cutter mechanism 220 from the BP to the HP (when paper cutting is not performed), after the acceleration time of the cutter mechanism 220 has elapsed, the drive current value of the cutter motor 227 is monitored until the cutter mechanism 220 reaches the HP.

Consequently, in a state in which the drive current of the cutter motor 227 is stable, it can be detected whether or not a foreign substance has become lodged in the cutter mechanism 220, so mis-detection can be reduced in foreign substance detection.

Also, even if it is detected that a foreign substance has become lodged, the cutter mechanism 220 is not stopped immediately, and instead is stopped after the paper has been cut. Accordingly, cutting of the paper by the weight of the paper itself can be avoided, so there is no tearing of the printed image portion.

Embodiment 2

Next, Embodiment 2 will be described. The configuration of the printing apparatus 10 according to Embodiment 2 is the same as that in FIGS. 1 to 4 that illustrate Embodiment 1, so this will not be described again, and the description will focus on the differences from Embodiment 1. First, one difference in the configuration is that the stop position detecting sensor 407 on the BP side can be omitted in Embodiment 2.

Figure 6:
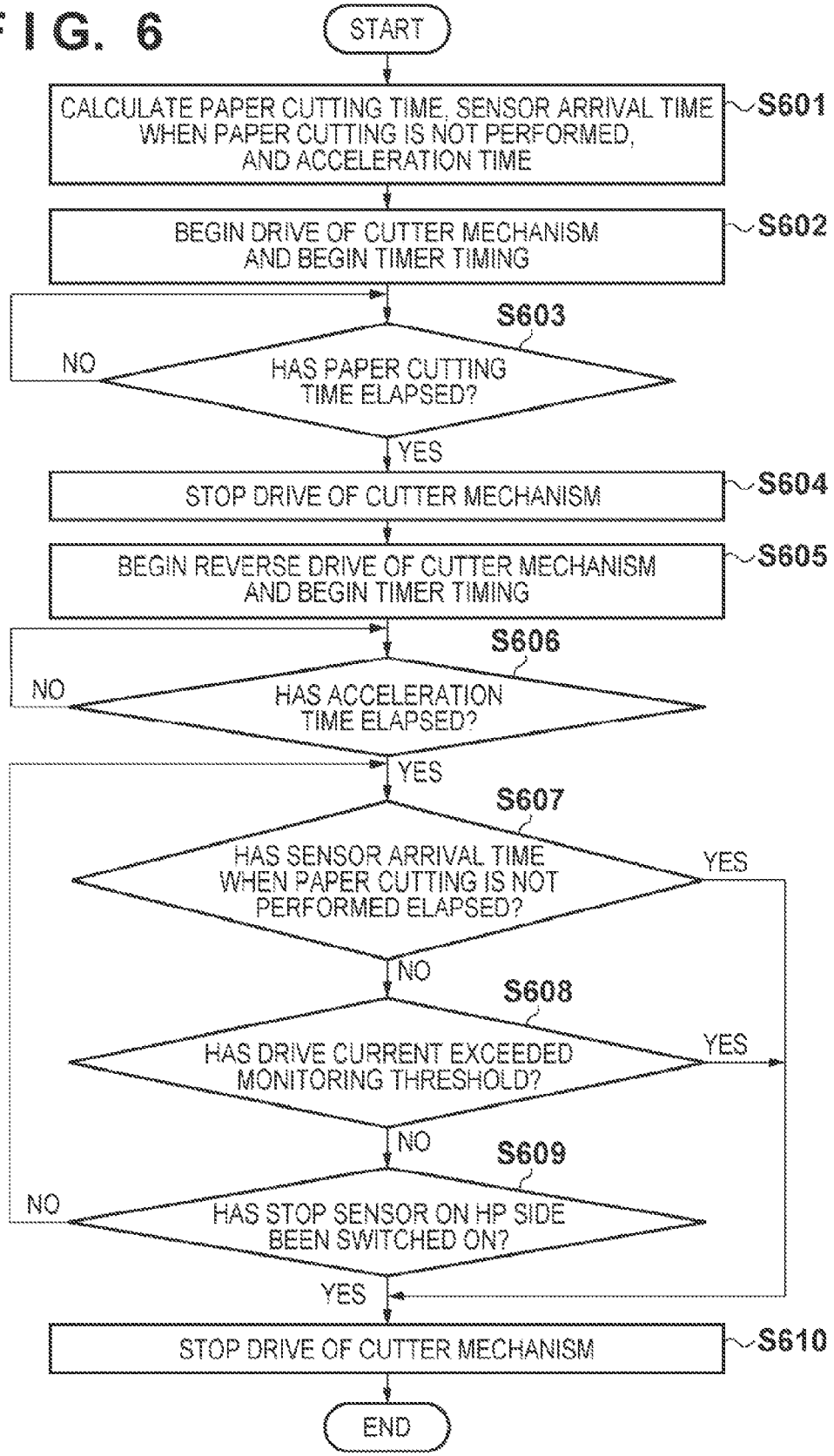
FIG. 6 is a flowchart of an example of the flow of paper cutting processing according to Embodiment 2.

An example of the flow of paper cutting processing according to Embodiment 2 will now be described through reference to FIG. 6.

This processing begins when the printing apparatus 10 finishes printing an image on paper. When this processing begins, the printing apparatus 10 first uses the calculation unit 312 to obtain values for the paper type and width determined by the paper determination unit 311, and various information according to the cutting of paper on the basis of the moving speed of the cutter mechanism 220 (S601). More specifically, the paper cutting time, the sensor arrival time when paper cutting is not performed, and the acceleration time are calculated. Specifically, the sensor arrival time when paper cutting is performed is not calculated in Embodiment 2. The sensor arrival time when paper cutting is not performed in Embodiment 2 indicates the time it takes for the cutter mechanism 220 to reach the stop position detecting sensor 406 on the HP side from the point when it begins moving from the paper cutting completion position.

Next, the printing apparatus 10 uses the drive controller 313 to begin the drive of the cutter motor 227 and move the cutter mechanism 220 toward the BP side. Specifically, the paper cutting operation by the cutter mechanism 220 is commenced. The timing of the timer 219 is also commenced (S602).

The printing apparatus 10 at this point waits for the paper cutting time to elapse (No in S603). Once this time has elapsed (Yes in S603), the printing apparatus 10 uses the drive controller 313 to stop the movement (drive) of the cutter mechanism 220 (S604).

After cutting the paper by the processing in the above steps S601 to S604, the cutter mechanism 220 is stopped at the position where the cutting of the paper ended. The printing apparatus 10 returns the cutter mechanism 220 to its original position (moves it to the HP side), so the same processing is performed as in S508 to S513 in FIG. 5 illustrating Embodiment 1 (S605 to S610). Consequently, the cutter mechanism 220 is stopped at the HP, and returns to its original position.

As described above, with Embodiment 2, when the paper is cut by the cutter mechanism 220, the cutter mechanism 220 is returned to the HP from the position where this cutting ended. In returning the cutter mechanism 220 to the HP, just as in Embodiment 1, after the acceleration time of the cutter mechanism 220 has elapsed, the drive current value of the cutter motor 227 is monitored until the cutter mechanism 220 reaches the HP.

Consequently, in addition to obtaining the same effect as in Embodiment 1 above, the time it takes for paper cutting processing can be shortened. Also, since the stop position detecting sensor 407 on the BP side can be omitted, the cost can be reduced correspondingly.

The above are examples of typical embodiments of the present invention, but the present invention is not limited to the embodiments given above and shown in the drawings, and can be suitably modified without departing from the gist thereof.

For example, in the above description, the paper determination unit 311 determined the paper type and width on the basis of the output values from the paper determination sensor 228, but this is not the only option. For example, the paper determination unit 311 may be constituted so as to determine the paper on the basis of the paper type, size, etc., manually inputted by the user.

Also, the above-mentioned paper cutting apparatus may be applied to something other than the above-mentioned printing apparatus 10, such as a facsimile apparatus, an apparatus having a scanner, printer, or other such function (called a copier, etc.), an apparatus that adds to this constitution a function such as a facsimile unit (called a multi-functional peripheral, etc.), or the like.

In the above description, a case of cutting rolled paper as the paper was given as an example, but the above-mentioned cutting processing may instead be performed on cut paper.

As described above, with the present invention there is less mis-detection during the detection of whether or not a foreign substance has become lodged in the cutter mechanism, and the paper cutting processing can be carried out properly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-031257 filed on Feb. 16, 2011, which is hereby incorporated by reference herein in its entirety.

What is claimed is:

1. A paper cutting apparatus, comprising:

a cutting unit configured to cut paper;

a moving unit configured to move the cutting unit from a moving start position to a stop position in a cutting direction intersecting the conveyance direction of the paper;

a motor configured to drive the moving unit;

a detection unit configured to detect a current value of the motor;

an obtaining unit configured to obtain a paper cutting time required for the cutting unit to pass through the paper in the cutting direction from the moving start position to a distal end of the paper, and a moving time required for the cutting unit to move from the start position to the stop position; and a control unit configured to stop, before the moving time has elapsed, the drive of the motor on the basis of the current value, wherein the control unit does not execute determination for determining whether to stop the drive of the motor based on the current value, before the paper cutting time has elapsed following the start of movement of the cutting unit from the moving start position to the stop position, and wherein the control unit begins the determination after the paper cutting time has elapsed following the start of movement of the cutting unit from the moving start position to the stop position.

2. The paper cutting apparatus according to claim 1, further comprising an arrival detection unit configured to detect that the cutting unit has reached the stop position.

3. A printing apparatus, comprising the paper cutting apparatus according to claim 1, and a printhead.

4. The paper cutting apparatus according to claim 1, wherein the obtaining unit obtains the paper cutting time on the basis of information regarding a width of a paper and information regarding a moving speed of the cutter unit.

5. The paper cutting apparatus according to claim 1, wherein the control unit stops the drive of the motor before the moving time has elapsed if it is determined that the current value exceeds a threshold.

6. The paper cutting apparatus according to claim 1, wherein the control unit does not stop the drive of the motor before the moving time has elapsed if it is determined that the current value does not exceed a threshold.

7. The paper cutting apparatus according to claim 1, wherein the control unit stops the drive of the motor before the moving time has elapsed if the current value detected by the detection unit exceeds a threshold.

8. The paper cutting apparatus according to claim 1, wherein the control unit stops the drive of the motor before the moving time has elapsed if it is determined that an increase in the current value detected by the detection unit in a specific length of time exceeds a threshold.

9. The paper cutting apparatus according to claim 1, wherein the obtaining unit further obtains an acceleration time during which a current supplied to the motor increases in which the cutting unit moves from the stop position to the moving start position, and a second moving time required for the cutting unit to reach the moving start position from the stop position, and wherein, while the cutting unit starts to move from the stop position to the moving start position, the control unit starts to determine, after the acceleration time has elapsed, whether to stop the drive of the motor on the basis of the current value before the second moving time has elapsed.

* * * * *